US006634644B2

(12) United States Patent
Falana

(10) Patent No.: US 6,634,644 B2
(45) Date of Patent: Oct. 21, 2003

(54) CONCEALMENT-TYPE WORD PUZZLE/ GAME

(76) Inventor: Jeffrey W. Falana, 7 Ogden Ave., Collingswood, NJ (US) 08108-2016

( * ) Notice: Subject to any disclaimer, the term of this patent is extended or adjusted under 35 U.S.C. 154(b) by 0 days.

(21) Appl. No.: 10/055,596

(22) Filed: Jan. 23, 2002

(65) Prior Publication Data

US 2003/0137105 A1 Jul. 24, 2003

(51) Int. Cl.[7] ..... A63F 3/00

(52) U.S. Cl. ..... 273/272; 273/299; 273/430; 273/157 A; 434/167

(58) Field of Search ..... 273/156, 157 A, 273/429, 430, 299, 157 R, 272; 434/167, 177, 433

(56) References Cited

U.S. PATENT DOCUMENTS

| | | | | | |
|---|---|---|---|---|---|
| 4,185,830 | A | * | 1/1980 | James | 273/157 R |
| 4,509,758 | A | * | 4/1985 | Cole | 380/59 |
| 5,479,506 | A | * | 12/1995 | Rehm | 380/1 |
| 5,553,856 | A | * | 9/1996 | Barnard | 273/156 |
| 5,813,672 | A | * | 9/1998 | Loud, Jr. | 273/272 |

* cited by examiner

*Primary Examiner*—Kien T. Nguyen
(74) *Attorney, Agent, or Firm*—Donald C. Simpson

(57) ABSTRACT

A word puzzle/game in which the letters of the word or words are "concealed" by superimposing letters of the same known font on the letters of the words.

4 Claims, 6 Drawing Sheets

CONCEALMENT-TYPE WORD PUZZLE/ GAME

FIELD OF INVENTION

This invention relates to word puzzles and to games based on the word puzzles in which the player attempts to identify one or more concealed words.

BACKGROUND OF THE INVENTION

Word puzzles have long fascinated the public, as is evidenced by the great variety of crossword puzzles, cryptograms, acrostics, anagram, and the like.

U.S. Pat. No. 4,678,201 to Riviera describes a puzzle of the crossword puzzle type in which a word-defining matrix is premarked with symbols. The symbols consist of either letters which can be converted into other letters, or partial letters which can be converted into two or more other letters. In essence, the Rivera puzzle consists essentially of a standard crossword puzzle in which clues to the correct answers are given by means of the symbols incorporated into the crossword puzzle spaces.

U.S. Pat. No. 5,860,653 to Jacobs relates basically to anagram-type games, and provides an extensive discussion of this type of game and the problems associated with adapting the game of anagram for the television viewer and/or the computer user. The Jacobs' patent, however, is more concerned with the manner of delivery of the game for these particular media, and does not really offer a new type of game.

U.S. Pat. No. 5,338,043 to Rehm, provides an excellent description of puzzles of the cryptogram type. Rehm developed a new type of cryptographic puzzle that is somewhat faster and simpler than the usual cryptogram and provides clues and decoding options involving logical "guessing" which can lead to the solution with minimal corrections.

As can be seen from the foregoing, the several patents do not define so much new games as much as they define modifications of existing games for the purposes of simplifying them for the solver, or for presentation to various media.

SUMMARY OF THE INVENTION

The present invention is a puzzle that has certain elements common to these various other word games and yet has a distinct modus operandi such as to result in a new puzzle and a new game based on that puzzle. In the puzzle of the present invention, the word or words to be identified are in plain view, are not scrambled, and are in neither cipher nor code. The letters of the word or words are, however, "concealed" by superimposing letters of the same known font on the letters of the words, thereby leaving it to the puzzle solver to pick and choose combinations of letters which will lead to the solution of the puzzle.

DETAILED DESCRIPTION OF THE INVENTION

A cryptogram is generally produced by encoding or enciphering plain text, and the recipient of the cryptogram then deciphers or decodes it. Generally, cipher systems involve either transposition or substitution, or a combination of transposition and substitution of letters and/or text. Code systems are generally a specialized form of substitution cipher system in which the cryptographer treats syllables, words, phrases, and even whole sentences as the basis for substitution; in code systems, a code book is generally required for the message recipient to read the coded message.

The present invention involves neither a cipher nor a code but is of the genre known as a concealment system in which text is hidden in an otherwise innocent message or disguise. Puzzles or games of the present invention involve printing the puzzle word in a uniform font and superimposing letters of the same font on one or more letters in the puzzle word so as to conceal the puzzle word from the casual viewer. It then becomes the responsibility of the puzzle solver to attempt to reverse the process in a manner so as to reveal the hidden puzzle word. The combination of the puzzle word with the concealing letters is referred to hereinafter as a "concealogram."

Figure 1:
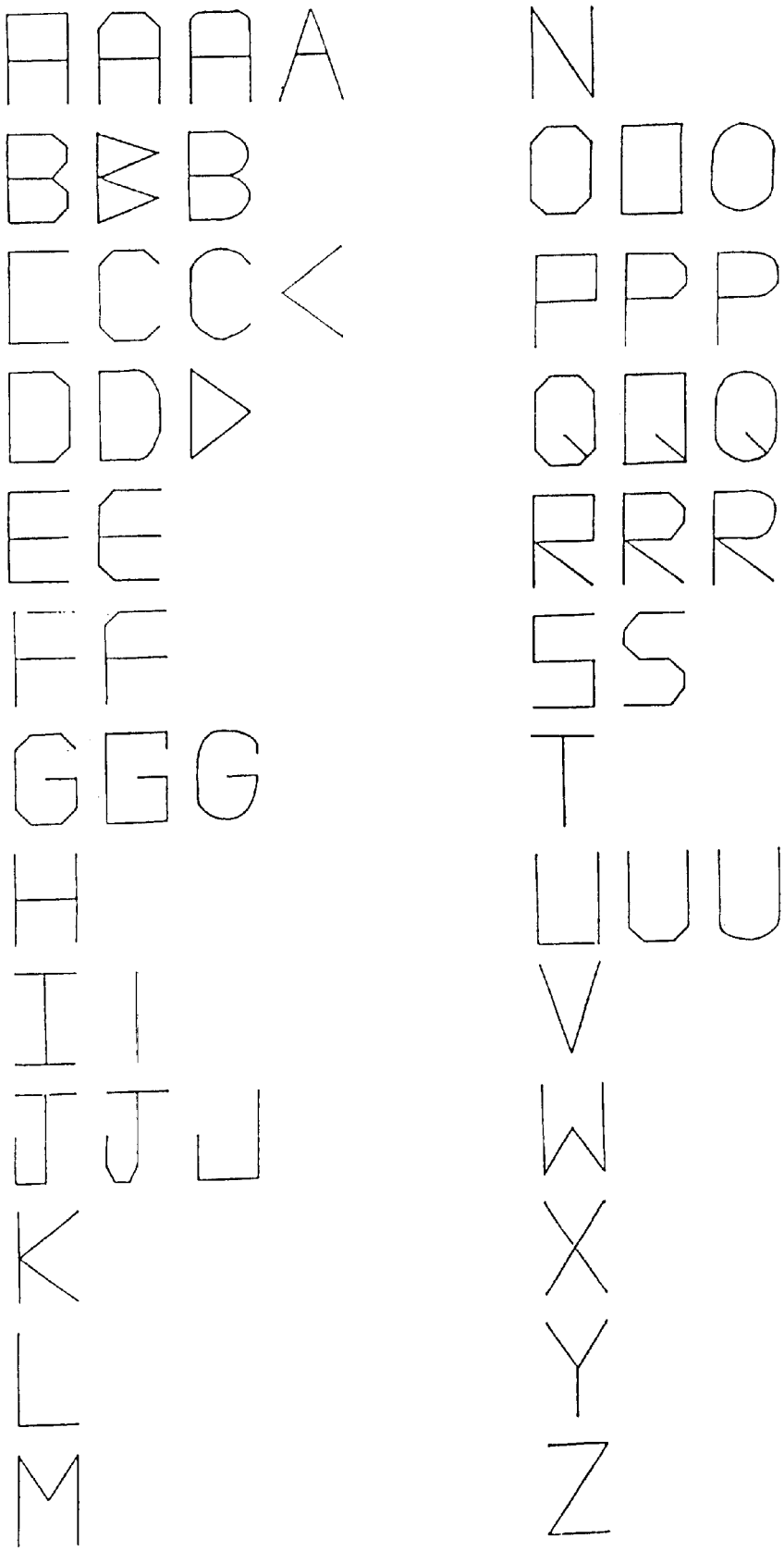
FIG. 1 is a drawing of the various letters of the alphabet in various type styles which may be useful for the purposes of the present invention.

The invention may be better understood with reference to the drawings. The printed letters of the alphabet can frequently be presented in a number of different variations of shape. This is illustrated in FIG. 1, in which the letters A and C are shown with four different variations of shape and other letters are shown with anywhere from one to three different shapes. This figure is not intended to be exhaustive; other shapes can be developed for the various letters. It is, however, important that the puzzle solver be told the font being used by the puzzler in creating the concealogram. For purposes of this disclosure, a font is defined as an alphabet made up letters of known shape and size. An example of one such font is provided in FIG. 2. This particular font is made up of a combination of mostly "squared" letters and some "rounded" letters. For each concealogram, the choice of the members of the font is entirely up to the puzzle creator, provided that the puzzle solver is made aware of the particular font used by the puzzle creator. Such defined fonts are referred to hereinafter as "cryptofonts" to distinguish them from other fonts used in the printing trade; some of these cryptofonts may, however, correspond to standard fonts. The use of the cryptofonts will be better understood by an examination of FIGS. 3 and 4.

Figure 2:
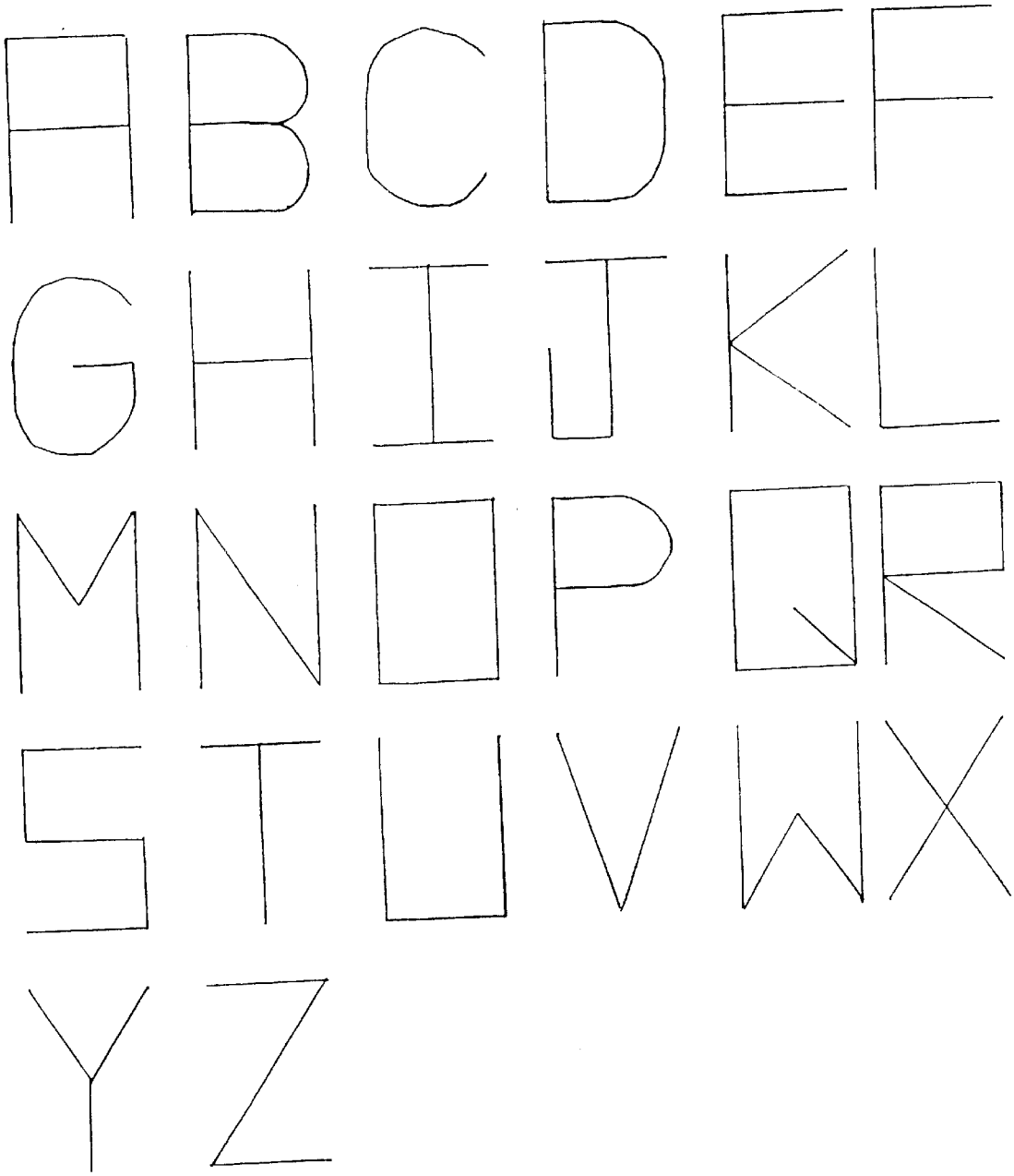
FIG. 2 is a drawing of an illustrative font which can be used for the purposes of the present invention.
Figure 3:
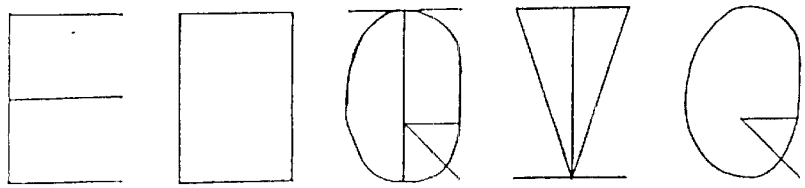
FIGS. 3 and 4 are drawings of examples of two different puzzles according to the present invention which have the same solutions.

FIG. 3 is a creatogram made up using the cryptofont of FIG. 2. As will be observed, in these puzzles, the units of overlaid letters are similar to monograms but the individual letters making up the unit are not necessarily immediately apparent. For the purposes of this invention, these overlaid units will be referred to as "fontograms." Depending on the particular cryptofont employed, some of the "letters" are natural fontograms. Thus, in the example of FIG. 3, the first unit would appear to be merely the letter E, but, in fact, can be viewed as a fontogram of the letters E, F, and L. Similarly, the second unit, which appears to be merely the letter O can be viewed as the fontogram of O, L, and U. The remaining three fontograms are created fontograms, as distinct from natural fontograms, with the third fontogram created from the letters T, C, Q, and G, the fourth fontogram created from the letters I, T, and V, and the fifth fontogram created from the letters C, Q, and G. Once the puzzle solver sorts out the various possible letters represented by the fontograms, it then remains to the puzzle solver to seek out the unique solution to the puzzle to find the concealed word. In the case of FIG. 3, the concealed word is "LOGIC."

Figure 4:
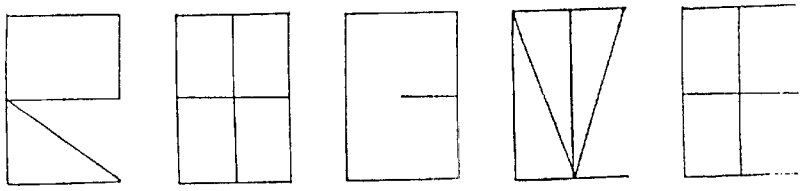

FIG. 4 illustrates the cryptofont dependency of the concealograms. The hidden word in FIG. 4 is the same as in FIG. 3, "LOGIC," but a different cryptofont has been used. In the case of FIG. 4, the cryptofont is made up entirely of the "squared" letters. The use of the squared alphabet in the formation of the fontogram can add an additional degree of difficulty to the puzzle solving. Thus, as shown in FIG. 4, the second fontogram now includes the letter C and, additionally includes the letters H and I.

Figure 5:
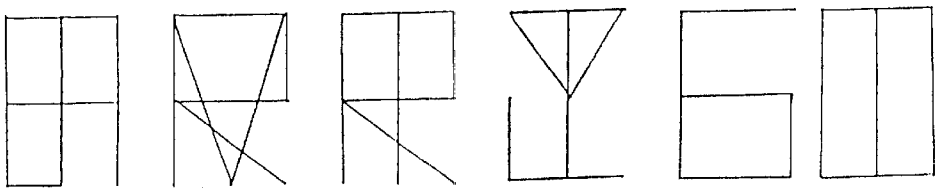
FIG. 5 is a drawing of another puzzle example.

FIG. 5 illustrates how the concealogram may be enhanced by clues. Thus, one or more of the following clues might be given to assist the puzzle solver:

A. Puzzle category: human endeavor;

B. The word contains two syllables;

C. A person with talent.

The unique solution of the concealogram "ARTIST" may be determined without the clues, but clues may be given to reduce the difficulty and/or to shorten the amount of time necessary to solve the puzzle.

Figure 6:
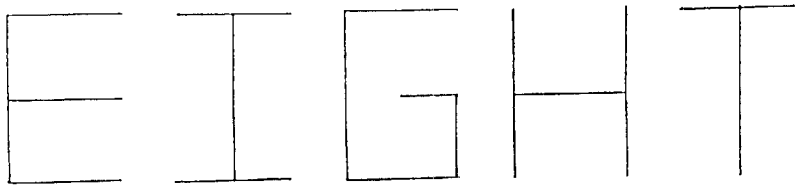
FIG. 6 is a drawing of a puzzle which itself is a word that has two additional words concealed within it according to the rules of the puzzle game of this invention.

FIG. 6 presents a somewhat different type of concealogram. At first glance, there appears to be no puzzle at all, but only the word "EIGHT". If, however, the word is treated as a concealogram, it can be seen that the E is a natural fontogram that includes the letters F and L, the I is a natural fontogram that includes the letter T, and the letter G is a natural fontogram containing the letter C. Accordingly, when treated as a concealogram, the word EIGHT yields the additional words of "FIGHT" and "LIGHT." This is, of course, a simplified example; more complex examples of this type can be created.

Figure 7:
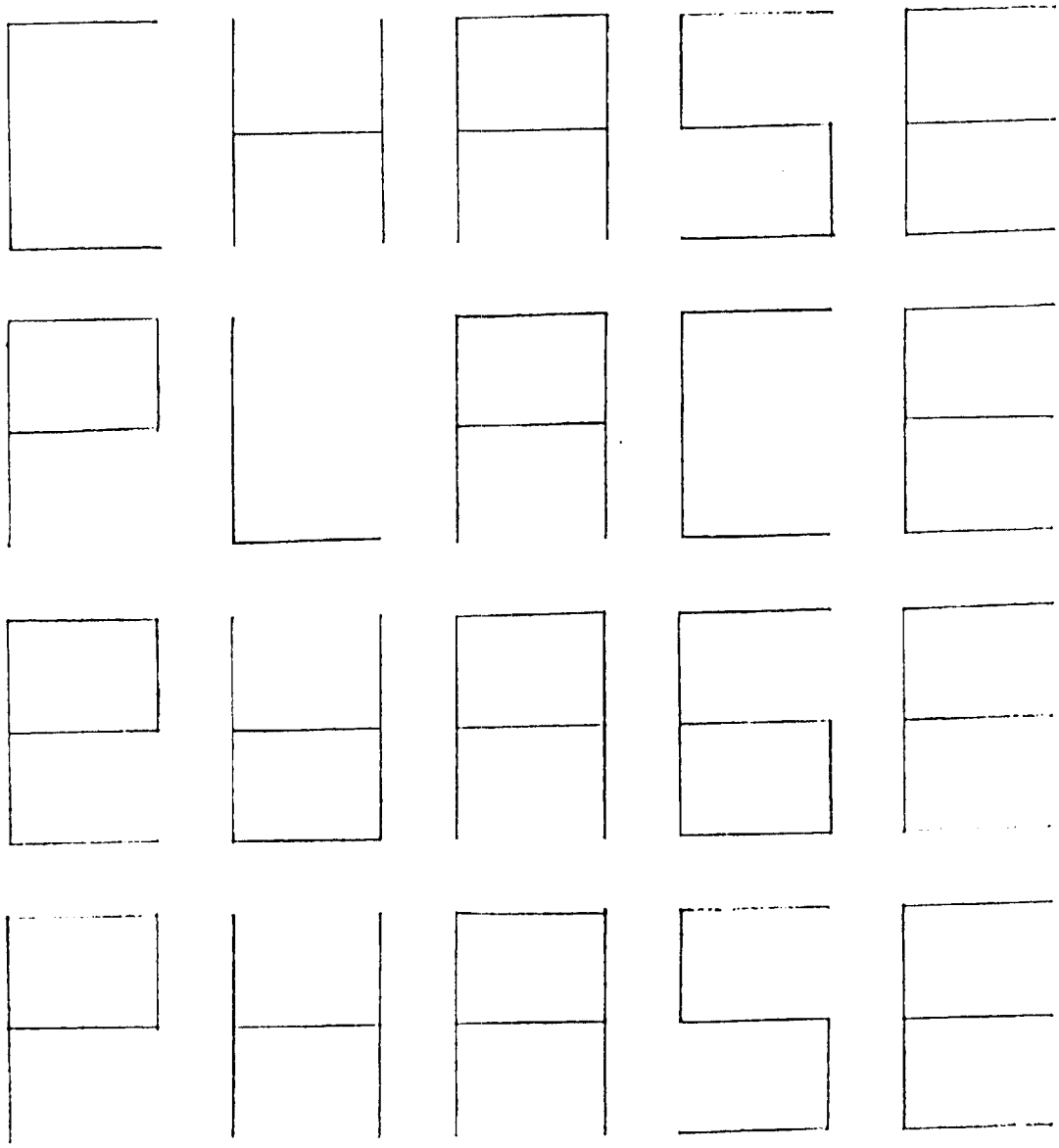
FIG. 7 is a drawing of a different variation of the puzzle of the present invention.

FIG. 7 illustrates a variation of the foregoing puzzles in which two words printed in the same cryptofont are superimposed on each other to form a concealogram which can then be broken down to reveal a third word. Thus, as shown, the word "CHASE" can be superimposed on the word "PLACE" to form a concealogram containing the word "PHASE." Once again, a simple example has been chosen for clarity of explanation. More complex variations are possible.

Figure 8:
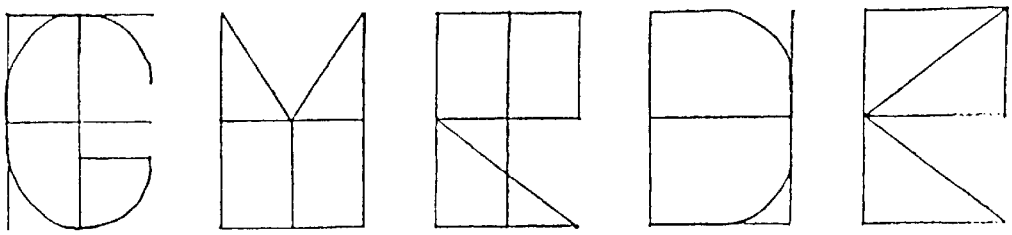
FIGS. 8, 9, and 10 are drawings of somewhat more complex puzzles prepared according to the present invention.
Figure 9:
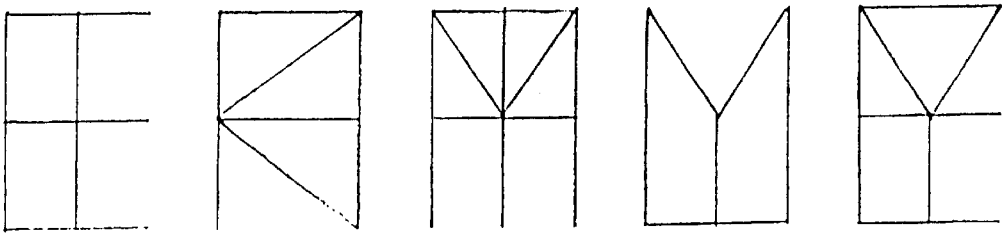

FIGS. 8 and 9 illustrate somewhat more complex concealograms formed from the cryptofont of FIG. 2. These are complex only with regard to the numbers of letters that are overlaid in each case. The answers respectively are "CHIDE" and "FRAME"

Figure 10:
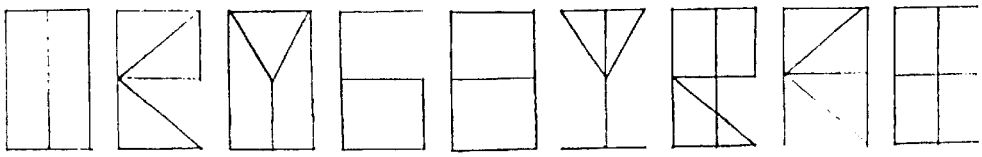

A still more complex puzzle is illustrated in FIG. 10 in which the concealed word is much longer than previously shown, and the cryptofont made up of completely squared letters is utilized. The unique solution in this case is "CELESTIAL."

Figure 11:
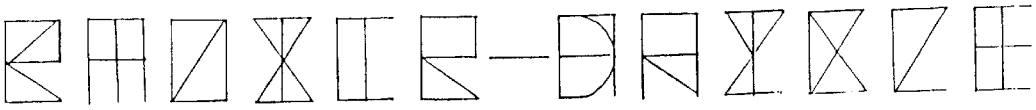
FIG. 11 is a drawing of a two-word phrase variation of the present invention.

The present invention is not limited to single words. Phrases, or even sentences, can be converted to a concealogram format. FIG. 11 is a concealogram of the phrase "RAZZLE-DAZZLE" using the cryptofont of FIG. 2. More complex puzzles can be designed. For example, the phrase "RAZZLE-DAZZLE" can be overlaid with the phrase "TEETER-TOTTER" to form a compound concealogram, or the concealogram of FIG. 11 can be overlaid with the phrase "TEETER-TOTTER" to provide a more complex concealogram with two possible solutions. Similarly, two sentences may be overlaid, one on the other, if the sentences and the words of the sentences are chosen carefully. As an example, "THE SKY WAS BLUE" may be overlaid with "OUR DOG CAN JUMP" to provide a complex concealogram having two separate sentences as the solution.

The puzzle procedure of the present invention can be used competitively between two or more parties. For example, the players may be provided with the same creatogram at the same time and the first to solve it is the winner of that particular event and can score points or more spaces along a board, et cetera. Similarly, the players may have a certain period of time in which to design a creatogram and thereafter exchange creatograms with an opponent with the first party who solves an opponent's creatogram being the winner. Other variations of game play will be readily apparent to persons interested in cryptofonts, fontograms, and creatograms of the present invention.

The foregoing description of the preferred embodiment of the invention has been presented for the purpose of illustration and description. It is not intended to be exhaustive or to limit the invention to the precise forms disclosed. The various puzzles and the games based on the puzzles are readily adaptable for use on computers by standard programming techniques. Many modifications and variations are possible in light of the above teaching. It is intended that the scope of the invention be limited not by this detailed description, but rather by the claims appended hereto.

What is claimed is:

1. A method of creating a word puzzle, said method comprising the steps of:

A. Defining a cryptofont by selecting alphabet letters of known size and unique shape to form an alphabet in which each letter is distinctive and represented only once;

B. Forming and displaying a puzzle word made up of letters selected from said cryptofont;

C. Superimposing on at least one letter of said puzzle a different letter selected from said cryptofont to form a fontogram; and D. Repeating step C as to other letters of said puzzle word until said puzzle word is concealed from the casual inspection of a puzzle solver.

2. A method of solving a concealment word puzzle, said method comprising the steps of:

A. Providing a concealment puzzle comprising a concealogram consisting essentially of the puzzle word made up of letters from a disclosed font in which letters in said word have been concealed by having superimposed thereon at least one other letter selected from the same font to form a fontogram;

B. Analyzing each unit of said concealogram including individual letters and fontograms to determine the letters represented by said unit; and C. Selecting from each of the possible letters for each fontogram the one that, when combined sequentially with the other letters for said puzzle, reveals the concealed puzzle word.

3. A method of playing a concealment word puzzle game comprising the steps of:

A. Defining a cryptofont by selecting alphabet letters of known size and unique shape to form an alphabet in which each letter is distinctive and represented only once;

B. Forming and displaying a puzzle word made up of letters selected from said cryptofont;

C. Superimposing on at least one letter of said puzzle a different letter selected from said cryptofont to form a fontogram;

D. Repeating step C as to other letters of said puzzle word until said puzzle word is concealed as a concealogram from the casual inspection of a puzzle solver; and E. Providing said concealogram to puzzle solver;

said puzzle solver performing the steps of:

F. Analyzing each unit of said concealogram including individual letters and fontograms to determine the letters represented by said unit; and G. Selecting from each of the possible letters for each unit, the one that when combined with the other selected letters for said puzzle reveals the concealed puzzle word.

4. A concealment-type puzzle comprising a concealogram consisting essentially of puzzle word made up of letters selected from a cryptofont, which word is formed and displayed in a single plane, said cryptofont comprising an alphabet of letters of known size and unique shape in which each letter is distinctive and represented only once, each letter of said puzzle word having superimposed on it a different letter selected from the same cryptofont.

* * * * *